US007398933B2

(12) United States Patent
Rueger et al.

(10) Patent No.: US 7,398,933 B2
(45) Date of Patent: Jul. 15, 2008

(54) INJECTION VALVE

(75) Inventors: Johannes-Joerg Rueger, Loren (AU); Wolfgang Stoecklein, Stuttgart (DE); Dietmar Schmieder, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 1295 days.

(21) Appl. No.: 10/276,833

(22) PCT Filed: Mar. 21, 2002

(86) PCT No.: PCT/DE02/01025

§ 371 (c)(1),
(2), (4) Date: May 13, 2003

(87) PCT Pub. No.: WO02/077437

PCT Pub. Date: Oct. 3, 2002

(65) Prior Publication Data

US 2004/0050971 A1 Mar. 18, 2004

(30) Foreign Application Priority Data

Mar. 21, 2001 (DE) ..... 101 13 560

(51) Int. Cl.
*F02M 47/02* (2006.01)
*F02M 41/16* (2006.01)
*F02M 61/00* (2006.01)
*F02M 63/00* (2006.01)
*F02M 37/04* (2006.01)

(52) U.S. Cl. ..... 239/533.8; 239/96; 239/533.2; 123/498

(58) Field of Classification Search ..... 239/533.8, 239/533.2, 96, 88, 92, 93, 102.2, 533.3, 533.6, 239/533.9, 584; 123/498, 445–447, 472
See application file for complete search history.

(56) References Cited

U.S. PATENT DOCUMENTS 4,749,897 A * 6/1988 Natsume et al. ..... 310/317
4,756,290 A 7/1988 Moritugu et al.

(Continued)

FOREIGN PATENT DOCUMENTS

DE 43 06 072 9/1994

(Continued)

OTHER PUBLICATIONS

Patent Abstracts of Japan, vol. 1999, No. 02. Feb. 26, 1999.

(Continued)

*Primary Examiner*—Darren W Gorman
(74) *Attorney, Agent, or Firm*—Kenyon & Kenyon LLP

(57) ABSTRACT

An injector, in particular an injector for a combustion engine, includes at least one nozzle module which has an injection nozzle and a supply line for a fluid under a supply pressure, and a valve-control module, which is in operative connection with the nozzle module, and at least one valve-closure member on which the supply pressure acts, and includes a piezoelectric actuator which is used to activate the valve-closure member and which is prestressed by a spring in the direction facing away from the valve-closure member, the piezoelectric actuator being activated by a valve-control unit which specifies a control gradient. The control gradient is a variable that is dependent upon the supply pressure.

3 Claims, 2 Drawing Sheets

U.S. PATENT DOCUMENTS

| | | | | |
|---|---|---|---|---|
| 4,784,102 | A | 11/1988 | Igashira et al. | |
| 5,057,734 | A * | 10/1991 | Tsuzuki et al. | 310/317 |
| 6,082,332 | A | 7/2000 | Hefler et al. | |
| 6,109,245 | A | 8/2000 | Egger et al. | |
| 6,146,102 | A * | 11/2000 | Otome et al. | 417/45 |
| 6,234,150 | B1 | 5/2001 | Watanabe | |
| 6,250,286 | B1 | 6/2001 | Hoenig et al. | |
| 6,253,736 | B1 * | 7/2001 | Crofts et al. | 123/498 |
| 6,332,455 | B1 | 12/2001 | Sumida et al. | |

FOREIGN PATENT DOCUMENTS

| | | |
|---|---|---|
| DE | 19548526 | 7/1997 |
| DE | 19711903 | 9/1998 |
| DE | 19833830 | 2/2000 |
| DE | 198 48 950 | 4/2000 |
| DE | 19902807 | 6/2000 |
| DE | 19930530 | 1/2001 |
| DE | 19939449 | 3/2001 |
| DE | 199 45 670 | 4/2001 |
| EP | 0790402 | 8/1997 |
| EP | 0894965 | 2/1999 |
| EP | 0994248 | 4/2000 |
| EP | 0893594 | 12/2003 |
| JP | 62055437 | 3/1987 |
| JP | 1113578 | 6/1989 |
| JP | 10 169524 | 6/1998 |
| JP | 10 306762 | 11/1998 |
| WO | WO 01/75289 | 10/2001 |

OTHER PUBLICATIONS

Patent Abstracts of Japan, vol. 1998, No. 11, Sep. 30, 1998.

* cited by examiner

INJECTION VALVE

FIELD OF THE INVENTION

The present invention is directed to an injector, in particular an injector for an internal combustion engine.

BACKGROUND INFORMATION

Such a valve may exist from the field. In particular, it may be used in connection with common-rail injection systems for diesel combustion engines. The configuration of the injector is such that it may be made up of a so-called nozzle module which may include an injection nozzle controlled by a nozzle needle, and may be activated by a so-called valve-control module having a valve-type configuration. The nozzle module may be controlled so that the nozzle module includes a valve-control space which is operatively connected to a valve-control plunger, the valve-control space also containing the fluid to be injected into the combustion chamber by the injector. A pressure change in the valve-control space effected by the valve-control module may cause a change in the position of the valve-control plunger and, thus, in the position of the nozzle needle forming a sub-assembly with the valve-control plunger as well.

As explained above, the valve-control module may have a valve-type configuration. Therefore, it may include a valve-closure member. The fluid pressure prevailing in the valve-control space of the nozzle module may act on this valve-closure member via a so-called discharge throttle. The valve-closure member may be activated by a piezoelectric actuator, which may act on the valve-closure member via a so-called control piston connected to the piezoelectric actuator, a hydraulic coupler and a so-called actuating piston connected to the valve-closure member.

When the piezoelectric actuator is activated, the valve-closure member of a valve-control module configured in this manner may be lifted off a valve seat which cooperates with it, so that the pressure prevailing in the valve-control space of the nozzle module may be reduced via the discharge throttle, thereby causing the injection nozzle to open.

A microprocessor specifying a particular control gradient may be used to activate the piezoelectric actuator. The control gradient may specify the period within which the voltage required for the expansion of the piezoelectric actuator is generated at the actuator, i.e., the period within which it obtains its maximum elongation.

A mechanical spring such as a spiral spring may prestress the piezoelectric actuator in the direction facing away from the valve-closure member. The reason for this is that the piezoelectric actuator may be unable to withstand tensile forces. In particular, such tensile forces may tear apart the individual layers of a piezoelectric actuator formed from a plurality of layers, so that short-circuits may occur and the injector may no longer be used. The magnitude of the resilience may influence only the operating point of the piezoelectric actuator, but not its lifting capacity.

In other prior injectors of the type mentioned at the outset, the compression spring may have a relatively high initial stress. However, this may require a relatively large space for the compression spring, which, in turn, may have a negative effect on the cost of the injector.

SUMMARY OF THE INVENTION

In contrast, a injector in accordance with an exemplary embodiment of the present invention may provide that a variable control gradient that is dependent upon the supply pressure, and that, due to the variable control gradient, the force effectively acting on the piezoelectric actuator may be kept constant, independently of the supply pressure (in the case of a common-rail injection system this is the so-called rail pressure), and that an activation of the piezoelectric actuator as a function of operating points may be achieved.

According to an exemplary embodiment of the injector in accordance with the present invention, the control gradient may increase with the supply pressure. This means that at a comparatively low supply pressure the excitation of the system, i.e., of the piezoelectric actuator, may occur more slowly than in the case of a comparatively high supply pressure.

This exemplary embodiment is based on the feature that, when the piezoelectric actuator is activated, the valve-closure member may be required to be first opened against the supply pressure. As soon as the force required to open the valve-closure member is exerted on the valve-closure member, i.e., when the so-called opening force is overcome, the valve-closure member may "fly" up and the piezoelectric actuator may expand very rapidly. Depending on the supply pressure, varying forces may act on the piezoelectric actuator in this phase. These forces may increase with a rise in the supply pressure.

Given a constant control gradient, i.e., an activation and excitation of the system that is independent of the supply pressure, the case of low supply pressure may pose a particular problem since the forces caused by the activation may be opposed by merely relatively low forces attributable to the supply pressure. However, according to an exemplary embodiment of the present invention, the activation may be implemented as a function of the supply pressure, so that the force acting on the actuator, i.e. the pressure relief, may be kept constant.

This, in turn, may have the result that the compression spring engaging with the piezoelectric actuator may have a relatively small and compact configuration and may need only be provided with a comparatively low initial tension. As a result, a relatively small space may be required for the compression spring and a clear cost reduction may be achieved.

DETAILED DESCRIPTION

Figure 1:
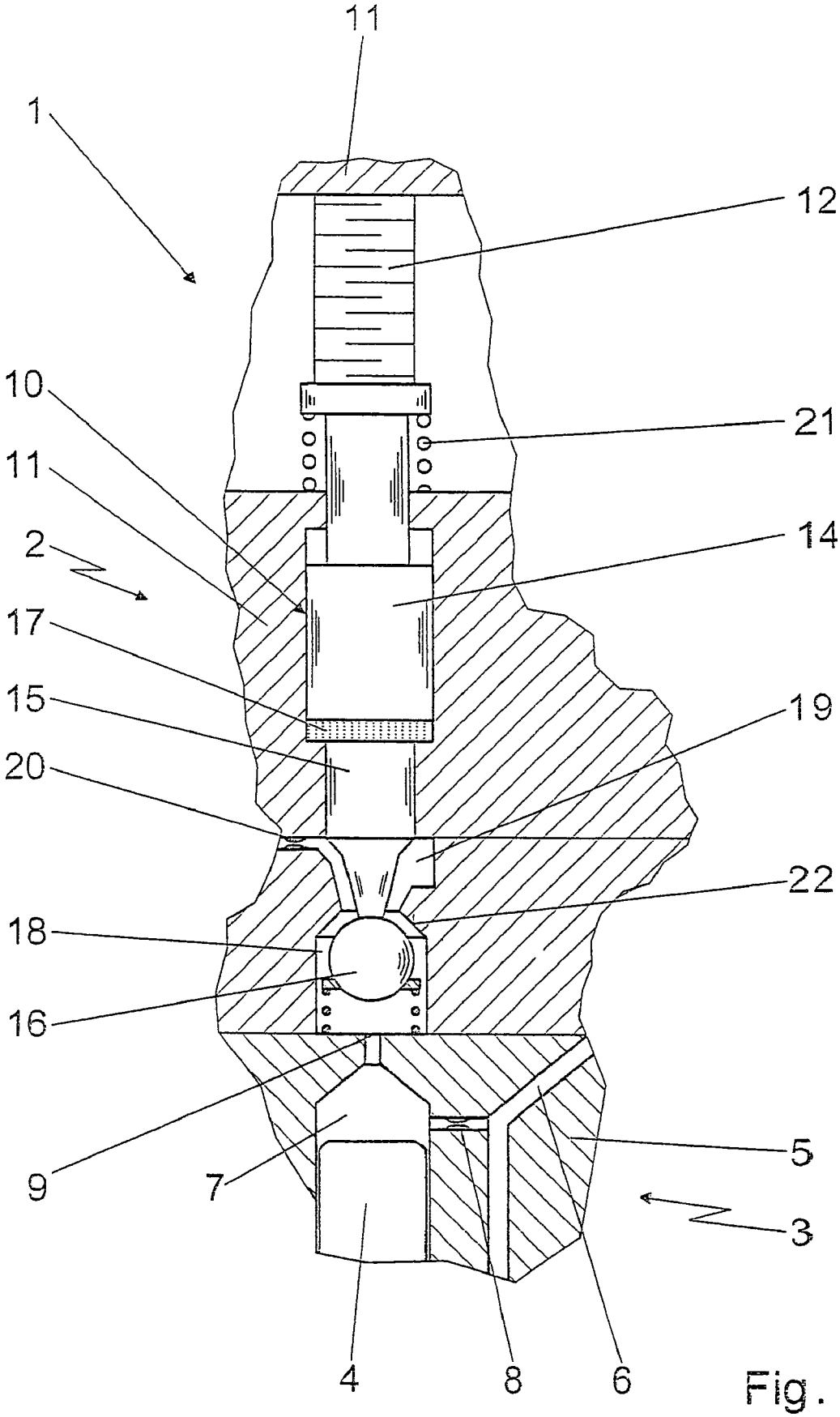
FIG. 1 shows a cutaway view of an injector according to an exemplary embodiment of the present invention, in longitudinal section.

The exemplary embodiment represented in FIG. 1 shows an injector 1 that is intended, for example, for the injection of fuel into a diesel combustion engine. For this purpose, injector 1 includes a valve-control module 2 and a nozzle module 3 having a nozzle body 5 in which a valve-control plunger 4 is located. Together with a nozzle needle (not shown here), the valve-control plunger 4 forms a subassembly, via which it controls, or may be identical to an injection nozzle.

Moreover, a fuel-supply channel 6 is formed in nozzle body 5 of nozzle module 3. Fuel-supply channel 6 is connected to a shared high-pressure reservoir, a so-called common rail of conventional configuration(not shown here), for a plurality of injectors. The fuel guided in high-pressure supply line 6 may thus be under a pressure, or rail pressure p_R, for instance, of up to 1.6 kbar.

A valve-control space 7, which is connected to fuel-supply channel 6 via an inlet throttle 8, abuts the free end face of valve-control plunger 4 shown in FIG. 1. The position of valve-control plunger 4 and, thus, of the nozzle needle is adjusted via the pressure level prevailing in valve-control space 7. For this purpose, valve-control space 7, via a discharge throttle 9, is connected to valve-control module 2.

The beginning and the duration of an injection process as well as the associated injection quantity may be adjusted with the aid of valve-control module 2. For this purpose, a valve member 10 is mounted in valve-control module 2, which is guided in a valve body 11 and is able to be activated by a piezoelectric actuator 12. Piezoelectric actuator 12 is located on the side of valve member 10 facing away from valve-control plunger 4 and, thus, from the combustion chamber of the internal combustion engine, acts on a piston 14, referred to as an operating piston, which is assigned to valve member 10. Furthermore, valve member 10 includes a second piston 15, a so-called actuating piston, which is used to activate a valve-closure member 16.

Actuating piston 15 itself is activated via a hydraulic coupler 17, which is configured as a hydraulic chamber and transmits the axial deflection of operating piston 14 moved by piezoelectric actuator 12 to actuating piston 15. The hydraulic transmission causes actuating piston 15 to produce a lift that is increased by the transmission ratio of the piston diameters, when operating piston 14, which here has a larger diameter than actuating piston 15, is moved a certain path length by piezoelectric actuator 12.

Valve-closure member 16 cooperates with a valve seat 22 which, in this case, is configured as a ball seat. However, in another exemplary embodiment of the valve-type valve-control module, the valve-closure member may cooperate with two valve seats, thus forming a double-seat valve.

Valve-closure member 16 is located in a valve chamber 18 which, given a non-activated piezoelectric actuator 12, is separated from a so-called discharge chamber 19, from which a discharge channel 20 branches off, by valve-seat member 16 cooperating with valve seat 22. This discharge channel 20 leads to a leakage connection (not shown further) of injector 1, which, in turn, is connected to a fuel storage tank.

A compression spring 21 prestresses piezoelectric actuator 12 in the direction facing away from valve-control plunger 4. Furthermore, piezoelectric actuator 12, in the usual manner, is made up of a plurality of layers and is connected by lines to a valve-control unit 30 schematically sketched in FIG. 2.

Figure 2:
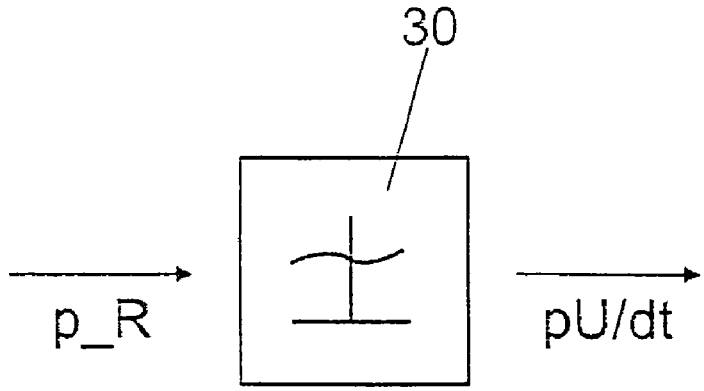
FIG. 2 shows a flow chart for actuating the injector in accordance with FIG. 1.

During operation of injector 1, valve-control unit 30 specifies, among others, a voltage gradient dU/dt for activating piezoelectric actuator 12. This so-called control gradient dU/dt is a function of the fluid pressure p_R prevailing in fuel-supply line 6 and may be set to the appropriate setpoint value by control unit 30. This is represented in FIG. 2 with the aid of a block diagram.

Figure 3:
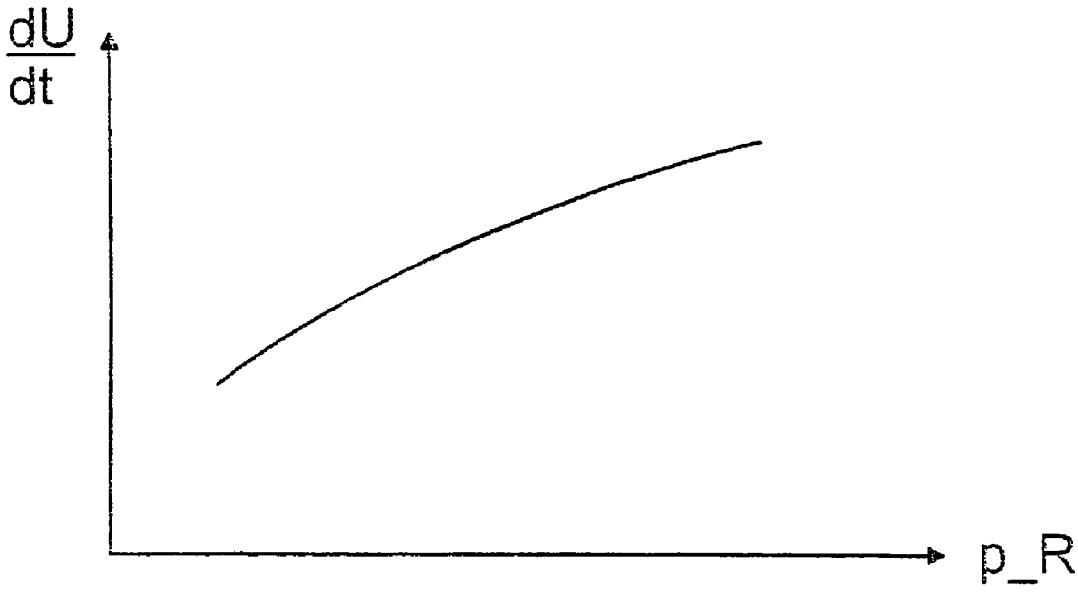
FIG. 3 shows the characteristics curve of a gradient for activating a piezoelectric actuator as a function of a fluid-supply pressure.

The fluid pressure, or rail pressure p_R, acts on valve-closure member 16 via inlet throttle 8, valve-control space 7 and discharge throttle 9. At high rail pressure p_R, the actuation of piezoelectric actuator 12 implemented by valve-control unit 30 occurs rapidly, i.e., valve-control unit 30 specifies a comparatively high control gradient dU/dt. In contrast, at low rail pressure p_R, valve-control unit 30 specifies a relatively low control gradient dU/dt. FIG. 3 shows the curve of control gradient dU/dt as a function of rail pressure p_R. As can be derived therefrom, control gradient dU/dt increases with rising rail pressure p_R.

What is claimed is:

1. An injector comprising:

a nozzle module including an injection nozzle and a supply line for a fluid that is under a supply pressure;

a valve-control module operatively coupled with the nozzle module;

at least one valve-closure member on which the supply pressure acts;

a piezoelectric actuator to activate the at least one valve-closure member;

a spring to prestress the piezoelectric actuator in a direction facing away from the at least one valve-closure member; and a valve-control unit to activate the piezoelectric actuator according to a control gradient, wherein the control gradient is a derivative with respect to time of a voltage supplied to the piezoelectric actuator by the valve-control unit, and is a variable that depends upon the supply pressure.

2. The injector of claim 1, wherein the injector is in a combustion engine.

3. The injector of claim 1, wherein the control gradient increases with the supply pressure.

* * * * *